US006148541A

United States Patent [19]

Favaro

[11] Patent Number: 6,148,541

[45] Date of Patent: Nov. 21, 2000

[54] FLUID-BED DRYING UNIT, PARTICULARLY FOR DRYING TOBACCO

[75] Inventor: Mansueto Favaro, Treviso, Italy

[73] Assignee: Garbuio S.p.A., Treviso, Italy

[21] Appl. No.: 09/257,864

[22] Filed: Feb. 26, 1999

[30] Foreign Application Priority Data

Mar. 4, 1998 [IT] Italy ..... TV98A0029

[51] Int. Cl.[7] ..... F26B 3/08

[52] U.S. Cl. ..... 34/360; 34/367; 34/369; 34/576; 34/583; 34/588; 34/168

[58] Field of Search ..... 34/134, 166, 168, 34/359, 360, 367, 369, 576, 580, 582, 585, 588, 593, 583

[56] References Cited

U.S. PATENT DOCUMENTS

| | | | |
|---|---|---|---|
| 4,251,925 | 2/1981 | Muhsil et al. | 34/48 |
| 4,305,210 | 12/1981 | Christensen et al. | 34/57 A |
| 4,434,563 | 3/1984 | Graalmann et al. | 34/28 |
| 4,766,912 | 8/1988 | Hackman et al. | 131/296 |
| 4,865,722 | 9/1989 | Ririe et al. | 209/474 |
| 4,885,848 | 12/1989 | Christensen | 34/57 R |
| 4,918,829 | 4/1990 | Harris | 34/10 |
| 4,924,600 | 5/1990 | Lermuzeaux | 34/10 |
| 5,022,164 | 6/1991 | Hansen et al. | 34/57 B |
| 5,357,688 | 10/1994 | Christensen | 34/369 |
| 5,716,751 | 2/1998 | Bertrand et al. | 430/137 |
| 5,775,265 | 7/1998 | Brandle et al. | 122/6 A |
| 5,839,207 | 11/1989 | Christensen et al. | 34/369 |

FOREIGN PATENT DOCUMENTS

| | | |
|---|---|---|
| 0430849 | 6/1991 | European Pat. Off. . |
| 218363 | 1/1973 | France . |
| 2337862 | 8/1977 | France . |
| 2508152 | 12/1982 | France . |

*Primary Examiner*—Pamela Wilson
*Assistant Examiner*—Andrea M. Joyce
*Attorney, Agent, or Firm*—Guido Modiano; Albert Josif; Daniel O'Byrne

[57] ABSTRACT

A fluid-bed drying unit, particularly but not exclusively used in the field of tobacco drying comprising a drying chamber having a loading inlet and an outlet for discharging the product and provided with openings for the passage of a drying medium. The drying chamber has a substantially tubular shape extending along a longitudinal axis and a substantially triangular vertical cross-sectional shape; the longitudinal axis is substantially inclined with respect to a horizontal axis and means are provided to inject a drying fluid substantially at right angles to the longitudinal axis.

9 Claims, 2 Drawing Sheets

1
2
3
4
5
6
7
8
9
12
α

FLUID-BED DRYING UNIT, PARTICULARLY FOR DRYING TOBACCO

BACKGROUND OF THE INVENTION

The present invention relates to a fluid-bed drying unit preferably but not exclusively used in the field of tobacco drying.

It is known that drying requires the control of all the various factors involved in this kind of process. In particular, the rate of transit or flow rate of the products through the drying chamber must be adjustable so as to keep the product therein for the time required for complete drying.

Furthermore it is necessary to remove the moisture produced by the process and to control the temperature and relative humidity of the drying fluid used.

Several kinds of drying units, which use different techniques, are known for this purpose in the field. For example, convection drying units are commercially available in which drying occurs by means of the heat exchange of a fluid which passes through the product to be dried, while conveyance occurs by way of a mechanical means (for example moving conveyors of the belt type or perforated-strip type, or vibrating conveyors).

Other conventional types of drying units are those which use combined conduction/convection, for example inside rotating cylinders or screw-feeder conveyors, in which drying occurs through the contact of the product against a warm surface of the conveyance means (for example the warm walls of the conveyor means) and by convection by way of a fluid which flows by the product and removes the moisture produced during the process.

Finally, so-called fluid-bed drying units are known whose characteristic is that they use only the drying fluid both for drying and for conveyance. In this case, the drying fluid flows over and through the product, warming it, and at the same time conveying it toward the outlet of the drying chamber.

A distinction is made between fluid-bed drying units with a nil fluid/product relative velocity (i.e., the fluid conveys the product at the speed at which the fluid itself travels) and fluid-bed drying units with a nonzero fluid/product velocity (i.e., the product is caused to float by the fluid during drying, and in the subsequent step the fluid conveys the product toward the outlet with nil fluid/product velocity).

These commercially known devices suffer many drawbacks. In particular, in the case of zero-velocity drying units, the length of the drying chamber must be great enough to allow the retention time of the product to be sufficient for complete drying. This implies considerable dimensions, which as such entail very high costs, and reduces the possibility to control the different steps of the process. These problems are even more strongly felt in the case of a soft drying process, in which the necessary length becomes almost impracticable.

Another drawback of this conventional drying unit relates to the distribution of the product inside the drying chamber. If the travel velocity of the product is constantly determined by the velocity of the fluid, a poor initial distribution of the product cannot be corrected during the process, consequently limiting the uniformity and quality of the drying action.

Yet another drawback of the existing drying units is that their drying chambers must also have rather significant height extensions, such as to provide a homogeneous dispersion of the product within the fluid. This also contributes to increase the bulk of the now available units.

Moreover, in the case of drying with a nonzero fluid/product velocity, there can be parts having a different mass or surface floating differently during drying. This entails a dependency between the mass/surface of the product and the exposure time.

The result is a difficult adjustment of the drying times and of the temperature of the fluid, with corresponding technical problems in the distribution of the temperature inside the drying chamber.

It is well-known that this type of drying is not suitable for flash drying, for which adjustment of the flotation and of the temperature is even more difficult.

SUMMARY OF THE INVENTION

The aim of the present invention is to solve the above drawbacks, by providing a device which ensures the flotation conditions of the product to be dried and in which at the same time the product can be conveyed along its path through the drying chamber regardless of the velocity of the drying fluid used.

A further object of the present invention is to provide an apparatus which is compact and whose operating cycle is economically satisfactory.

Still a further object of the present invention is to provide a drying process which is efficient from the point of view of the heat exchange between the drying fluid and the product.

This aim, these objects and others are achieved by a fluid-bed drying unit, which comprises a chamber for drying a product to be dried, said chamber being formed by an inlet for loading said product and by an outlet for discharging said product and being provided with openings for the passage of a drying medium, characterized in that said drying chamber is substantially tubular in a longitudinal direction and has a substantially triangular vertical cross-section, said longitudinal shape being substantially inclined with respect to a horizontal axis, means being provided to inject a drying fluid substantially at right angles to said longitudinal axis.

The method that achieves this aim and these objects is defined in appended claim 5.

BRIEF DESCRIPTION OF THE DRAWINGS

Further characteristics and advantages of the present invention will become apparent from the following description of some embodiments thereof, given only by way of non-limitative examples and illustrated in the schematic drawings, wherein.

DESCRIPTION OF THE PREFERRED EMBODIMENTS

With reference to the above figures, 1 designates a fluid-bed drying unit with nonzero fluid/product velocity, which is composed of a drying chamber 2 provided with a lateral loading inlet 3 for the product to be subjected to the process and with an outlet 4 which is located on the opposite side of said drying chamber 2, both being shaped conveniently and provided for example with a rotary airlock.

The drying chamber 2 is shaped so as to have a substantially triangular vertical cross-section 5 which diverges upward, producing a velocity of the fluid which can vary as a function of the variable passage section.

Figures 1, 2, 3:
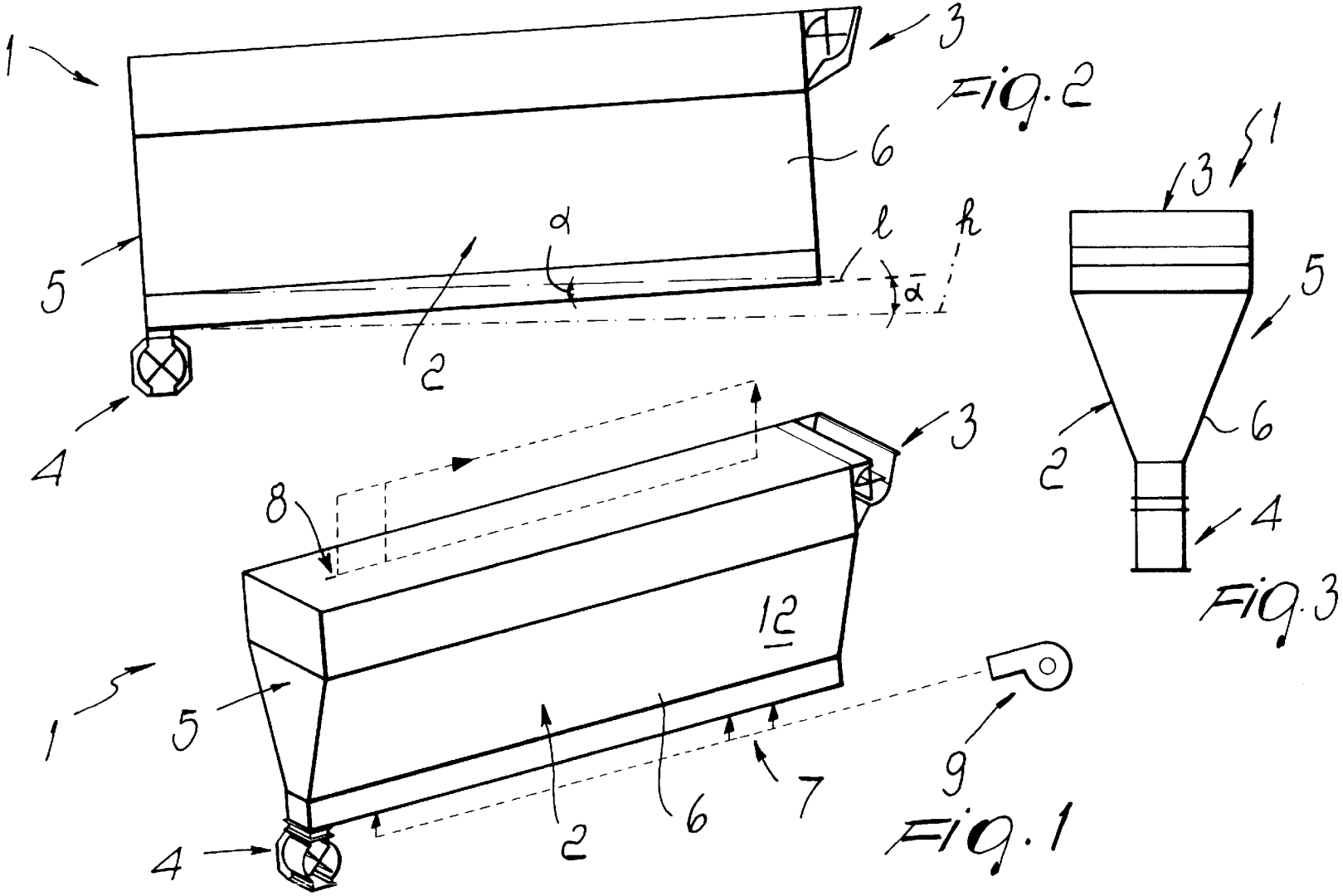
FIG. 1 is a schematic view of a diagram of an apparatus according to the invention.
FIG. 2 is a side view of the apparatus according to the invention.
FIG. 3 is an end view of the apparatus according to the invention.
Figure 4:
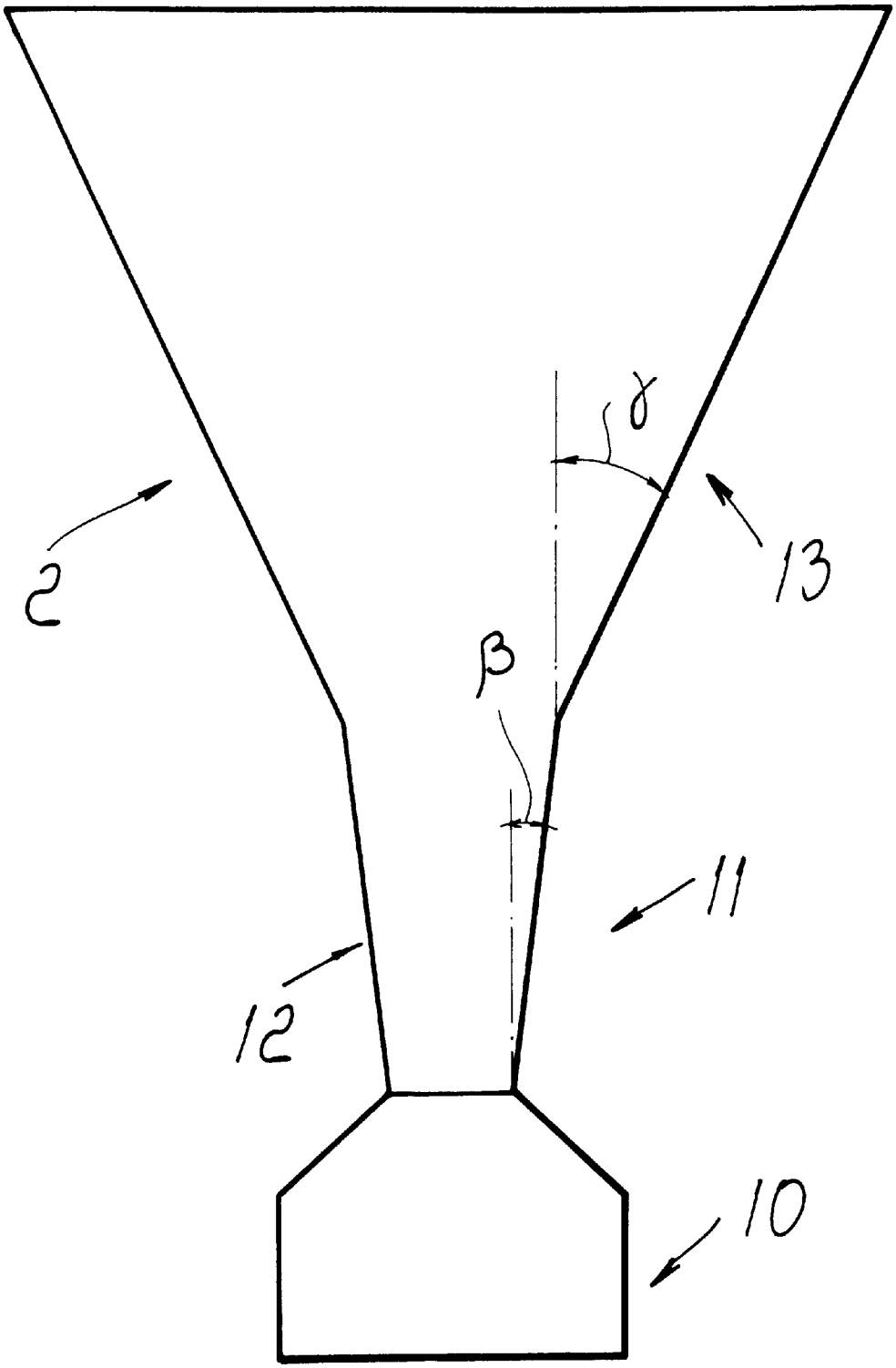
FIG. 4 is a cross-sectional view of a further embodiment of the apparatus according to the invention.

The horizontal view of the chamber shows that said chamber has a substantially tubular longitudinal shape 6 and comprises, on its lower side, openings 7 provided with fluid injection means communicating with the pipes for feeding the drying fluid, while at the upper side outlets 8 are supplied, in communication with the pipes for discharging the drying fluid, as shown schematically in FIG. 1.

The degree of divergence of the vertical triangular cross-section of the drying chamber is chosen conveniently so as to minimize the vortical component of the motion of the fluid and contain the vertical dimensions of the apparatus.

The drying chamber is preferably arranged along a longitudinal axis $\lambda$ which is inclined by an angle $\alpha$ with respect to the horizontal axis, which is designated by h.

Devices 9 may be further provided for adjusting the flow-rate of the drying fluid at the pipes for feeding said fluid into the drying chamber, so as to be able to adjust the flow-rate of the inflow of the drying fluid according to requirements.

The drying process that occurs in the drying unit according to the present invention is as follows.

In order to exert a conveyance action, the drying/floating fluid must impart to the product particles a small horizontal force component in the direction of product flow. Widely divergent sidewalls give a rapid reduction in velocity, such that the fluid flow is no longer able to support the product particles, which then float down to an area that has enough flow velocity to lift the product particles again. In practice, it appears that the product tends to float inside the chamber at a height level that corresponds to the speed of the fluid at which, for a given product, an equilibrium between the lift and gravity forces is achieved. Therefore the product particles float in a plane, substantially perpendicular to the direction of the fluid flow.

The product to be dried is fed into the drying chamber 2 through the appropriately provided lateral inlet 3 and is dragged into the stream of the drying fluid.

The fluid stream flows upward and as mentioned. Since the triangular vertical cross-section 5 of the chamber has side walls 12 diverging upwardly, the velocity of the fluid is higher in the lower part of the drying chamber and is lower in its upper part. Moreover, owing to the horizontal inclination with respect to the axis h of said chamber, the direction of the velocity of the stream of drying fluid is inclined from the vertical, while remaining substantially perpendicular with respect to the axis of the horizontal cross-section of said chamber.

The cross-sectional vertical extension of the chamber is such as to generate a range of velocities of the fluid between a minimum value and a maximum value, so as to produce the flotation of all of the product particles, even in the presence of nonuniform densities or surfaces thereof. Thus taking up of only light particles in an upward region (where the fluid velocity is lower) and the fall of heavy particles to the downward region (where the fluid velocity is higher) is avoided.

Accordingly, the product tends to settle in a flotation position that corresponds to a local velocity of the fluid which is equal to the velocity that provides an equilibrium between the aeraulic support and the force of gravity.

The fluid thus flows around the product, applying thereto the energy required to perform drying, and at the same time removes the generated moisture and keeps the product in a relative flotation condition.

At this point the conveyance of the product along the drying chamber 2 occurs by the effect of the inclination of said chamber, which prevents the particles from floating statically at a fixed level within the chamber. The particles instead, will follow the inclined motion direction of the fluid during the ascent step and will divert from such direction during the descent step. In this descent step the force of gravity instead will make them follow a vertical descendant path.

The mentioned inclination by an angle $\alpha$ of the chamber and also of the upward motion direction of the fluid with respect to the vertical, accordingly, determine an extent of the advancement (pitch) of the product for each complete oscillation between the maximum and the minimum speed point. The angle $\alpha$ may be selected in the range of 3°–15°, which ensures a suitable variation of the drying process time.

Accordingly, a "saw-tooth" movement condition, typical of a mechanically-actuated jolting or vibrating conveyor, is thus reproduced in a fluid-bed conveyance system.

The extent of the oscillations in the vertical direction can be controlled by using conventional devices 9 for adjusting the flow-rate of the fluid.

In this case the product is introduced in the drying chamber 2 during the maximum flow-rate phase of the fluid and therefore the subsequent vertical fall along the vertical, due to force of gravity, produces an oscillation whose extent and frequency are such as to produce a possibly very high horizontal conveyance velocity component which can in any case be adjusted according to requirements.

At the end of the process, the product thus dried leaves the drying chamber through the outlet that is provided laterally.

The above-described apparatus is susceptible of numerous constructive modifications and variations, all of which are within the scope of the claims.

Should the above-described product movement (provoked by the effect of the mere sloped configuration of the walls) be deemed insufficient, fluid flows may be provided with specific controlled profiles. A forced, suitably shaped fluid flow profile (for example, sinusoidal oscillatory, or other) to enhance the saw-tooth movement of the product particles may then be provided into the chamber 2, by way of adjustable fluid flow control devices 9, equipped with adapted flow control means.

In a further advantageous embodiment of the invention the chamber consists of a base 10, through which the drying and floatation fluid exits, substantially at right angles, from the base 10. To ensure that the particles to be dried are properly lifted and separated, a lower zone 11 is provided with inclined sides 12, at a relatively small divergent angle with respect to the vertical. Typically, but not necessarily, the side angles $\beta$ would be in the range of 7–15 degrees. It ensures that in the lower zone 11 the speed effect of the drying and floatation fluid opens fan-wise the stream of product particles and separate them, especially if they are interwined (e.g. cut tobacco lamina).

In order to limit the height of the particle distribution, once the particle stream has been opened and the particles separated, the inclination of the divergent sides 12 is increased further. Accordingly in the upper zone 13, typically, but not necessarily, the side angles $\gamma$ may be in the range of 15–30 degrees. The wider divergency angle also, helps limiting the overall height of the machine.

The process, otherwise, occurs as explained above.

The advantages of a fluid-bed drying unit according to the present invention with respect to the prior art are therefore readily apparent.

In particular, the unit according to the present invention has are more compact construction and therefore is economically advantageous, while its drying uniformity and efficiency are remarkable.

The product may be conveyed between the feed point and the discharge point by the drying fluid, at a velocity which is independent of the fluid velocity, depending instead on the inclination of the stream.

Finally, the oscillating motion allows the process to be uniform even for products with different particle densities or surfaces.

It will be understood that the term "particle" does not necessarily refer to only a small, minute piece, but also to larger pieces, such as the tobacco pieces in all its possible different forms (such as cut tobacco, tobacco strips, tobacco stems, expanded tobacco, etcetera).

The materials and the dimensions of the embodiments may be various according to requirements.

The disclosures in Italian Patent Application No. TV98A000029 from which this application claims priority are incorporated herein by reference.

What is claimed is:

1. A fluid-bed drying unit, for drying a product, including a drying chamber for the product to be dried, said chamber comprising: an inlet for loading said product; an outlet for discharging said product; openings for passage of a drying fluid, and fluid injection means for injecting the drying fluid substantially upwardly, at right angles to a longitudinal axis, and wherein said drying chamber is tubular, extends along said longitudinal axis, and has a triangular vertical cross-sectional shape, with inclined walls at a product processing region of said chamber, said longitudinal axis being inclined with respect to a horizontal axis, said drying fluid acting both as a drying and conveyance medium for said product from said inlet to said outlet of the drying chamber, along said longitudinal axis.

2. The fluid-bed drying unit of claim 1, wherein said longitudinal axis of said drying chamber is inclined downwardly, starting from said inlet of the drying chamber and towards said outlet.

3. The fluid-bed drying of claim 1, wherein said drying chamber has side walls forming a triangular vertical cross-sectional shape which diverge in an upward direction.

4. The fluid-bed drying unit of claim 1, comprising flow control devices for controlling an injection flow-rate of the drying fluid.

5. The drying unit of claim 3, comprising a base portion, a lower zone in which the side walls diverge upwardly at a first angle ($\beta$), and an upper zone, said upper zone diverging upwardly from said lower zone at a second angle ($\gamma$) said second angle ($\gamma$) being bigger than said first angle ($\beta$).

6. The drying unit of claim 5, wherein said longitudinal axis is inclined with respect to said horizontal axis at an inclination angle being in a range of 3–15 degrees.

7. The drying unit of claim 5, wherein said first angle is selected in a range of 7–15 degrees, and said second angle is selected in a range of 15–30 degrees.

8. A fluid-bed drying method for drying a product, comprising:

introducing the product in an inlet region of a drying chamber which has an upwardly diverging triangular cross-sectional shape;

injecting into a lower zone of said chamber a drying fluid with an inflow speed which is provided so as to be higher than an outflow speed;

providing an inclined direction of the drying fluid flow with respect to the vertical and orientating said flow in a direction being opposite with respect to a direction of the force of gravity to which particles of the product are subjected;

wherein each particle of the product subsequently undergoes a thrust in a direction of the fluid flow and a subsequent fall in the direction of the force of gravity, so that due to the inclined direction of the fluid flow the product particles perform a sawtooth oscillation.

9. The method of claim 8, wherein said oscillation is controllable in period and frequency.

* * * * *